US005727375A

United States Patent [19]

Jankowski

[11] Patent Number: 5,727,375

[45] Date of Patent: Mar. 17, 1998

[54] METHOD AND APPARATUS FOR STRANDING ELONGATED ELEMENTS INTO REVERSELY TWISTED STRAND

[75] Inventor: Jerzy Jankowski, Warsaw, Poland

[73] Assignee: The Northampton Machinery Company Limited, Northampton, United Kingdom

[21] Appl. No.: 615,305

[22] PCT Filed: Sep. 15, 1994

[86] PCT No.: PCT/GB94/02012

§ 371 Date: Jun. 17, 1996

§ 102(e) Date: Jun. 17, 1996

[87] PCT Pub. No.: WO95/08175

PCT Pub. Date: Mar. 23, 1995

[30] Foreign Application Priority Data

Sep. 16, 1993 [PL] Poland ..... 300409

[51] Int. Cl.[6] ..... D01H 1/10; D01H 7/86

[52] U.S. Cl. ..... 57/58.52; 57/58.54; 57/58.55; 57/58.63; 57/58.83; 57/67; 57/293; 57/294

[58] Field of Search ..... 57/293, 294, 58.52, 57/58.54, 58.55, 58.63, 58.83, 67

[56] References Cited

FOREIGN PATENT DOCUMENTS 0048130 3/1982 European Pat. Off. .

OTHER PUBLICATIONS

Week 7821, Derwent Publications Ltd., London, GB; AN 78-37690A & JP, A, 53 041 533 (Fujikura Cable Works) 15 Apr. 1978.

Patent Abstracts of Japan, vol. 17, No. 450 (E-1416) 18 Aug. 1993, & JP,A,51 001 728 (Yazaki), 23 Apr. 1993.

*Primary Examiner*—William Stryjewski

*Attorney, Agent, or Firm*—Salter & Michaelson

[57] ABSTRACT

Apparatus for stranding elongated elements into a bundle of reversely twisted strand sections includes a rotating accumulator drum, a rotating winding flyer at the first end of the drum, and a rotating unwinding flyer at the second end of the drum. A guide plate and collector die guide the elements into the winding flyer, and a twist blocking device guides the twisted strands out of the unwinding flyer. A first twist of the bundle is produced by the winding flyer in a zone between collector die the winding flyer. A second reverse twist is produced by the unwinding flyer in the zone between the unwinding flyer and the twist blocking device. The winding flyer, the drum and the unwinding flyer rotate around a common axis, in the same direction, but at different speeds which change in alternating winding phases. The speed of the flyers and the drum are different from each other, but constant within the particular winding phase. The speeds of the flyers and drums are selected so that the strands are drawn through the apparatus at a predetermined speed and so that twisting in reverse direction occurs in alternating sections as the strands are drawn through the apparatus. The speed of rotation of the flyers and drums also determines the tightness of the twist. Durations of the periodically changing speeds are preferably selected such that the length of the bundle stranded in one direction is equal to the length stranded in the opposite direction.

13 Claims, 4 Drawing Sheets

METHOD AND APPARATUS FOR STRANDING ELONGATED ELEMENTS INTO REVERSELY TWISTED STRAND

BACKGROUND OF THE INVENTION

The subject of the invention is a method and an apparatus for stranding elongate elements, such as wires and conductors of electrical cables, into a strand of a reverse twist, i.e. alternate left and right one, called SZ-type strand.

There are some well-known and widely applied various methods of stranding elements into strands. Generally, the methods can be divided into two groups: the unidirectional twisting (either left or right) and the alternate reverse twisting in, both directions (left and right), or hence called SZ twisting.

One of the known methods of unidirectional twisting is the method applied in single twist bunchers. A bundle of parallel elements enters a rotating flyer, along its axis of rotation situated horizontally. The task of the flyer is to twist the bundle and wind it up on a spool. The flyer has a shape of the letter L and is so arranged that its axis of rotation goes close to the end of its one segment and is parallel to another segment. Next, the bundle is guided along the flyer and after leaving the flyer is wound on the take-up spool, which rotates around the same axis as the flyer and in the same direction but with different speed. The twist is produced at the entrance to the rotating flyer and depends on the difference of rotational speeds of the flyer and the spool and on the diameter of a core on which the bundle is wound up.

The known methods of stranding elements with the alternate reverse twist, i.e. SZ-type, require application of long accumulators (stores). The accumulators of various constructions are placed between two holeplates: a fixed dividing holeplate at one end of a machine, and a periodically oscillating twisting holeplate, rotating alternately in both directions, at the other end downstream. In another type of SZ stranders, the accumulator is placed between twisters, rotating alternately with various speeds. The periodically alternate strand is produced due to periodical and sudden changes of rotational speeds of the plates or twisters.

An output of the mentioned above methods of the reverse stranding is limited by masses and diameters of the rotating plates and twisters, and particularly, by rotational inertia occurring when the direction or value of the rotational speed is suddenly changed. Consumption of energy, necessary to accelerate and brake the masses alternatively, is also relatively big. Long accumulators require large areas in workshops. An example of a method of continuous SZ twisting in which the direction of rotating the flyer and an intermediate storage drum are reversed with the disadvantages outlined above is described in JP-A-53041533. In this arrangement the twist generated is dependent on the diameter of the drum, so a drum charge would be necessary if a twist change were required.

SUMMARY OF THE INVENTION

The method of stranding elongated elements into the strand of reverse twists according to the invention, is based on the idea, that a bundle of elements is inserted into the winding flyer, producing the first twist in the bundle and winding the bundle on a drum which acts as an accumulator. Simultaneously, the bundle is unwound from the drum by means of an unwinding flyer, producing the second twist in the bundle. Next, the bundle is pulled out of the unwinding flyer. Both flyers and the drum have a common axis of rotation and rotate in the same direction. A repeating period of stranding the bundle of elements consists of at least two successive phases of twisting. A length of the bundle twisted in one phase by the winding flyer is next twisted in another phase by the unwinding flyer. The strand of the bundle is an algebraic sum of successive twists produced in particular phases of twisting.

In an advantageous solution, the bundle is twisted in two phases and during each of them rotations of the flyers and of the drum are constant. During the same phase of twisting the same rotational speed of the winding and unwinding flyers are applied and in both phases the same differences of rotational speeds between each flyer and the drum are maintained.

It is advantageous, if twisting is repeated, and after pulling out the bundle from the unwinding flyer it is inserted into the second winding flyer, producing the third twist in the bundle and winding it on the second drum, and simultaneously, the bundle is unwound from the drum by the second unwinding flyer, producing the fourth twist in the bundle. Next, the bundle is pulled out of the second unwinding flyer. The direction of rotation of the second winding flyer, the second drum and the second unwinding flyer is opposite to the direction of rotation of the first winding flyer, the first drum and the first unwinding flyer, and all the flyers and the drums have the common axis of rotation. The repeated period of twisting consists of at least two phases.

In the advantageous solution the bundle of elements is twisted in two phases during which rotations of the flyers and the drums are constant.

It is also advantageous, if the product of rotational speed of the first winding flyer and the diameter of the first drum is equal to the product of rotational speed of the second unwinding flyer and the diameter of the second drum, and both products are of the same value during both phases of twisting, as well as the product of rotational speed of the first drum and its diameter is equal to the product of rotational speed of the second drum and its diameter end both products are of the same value during both phases of twisting, and also, in each phase, the product of the diameter of the first drum and the difference between rotational speeds of the first unwinding flyer and the first drum is equal to the product of the diameter of the second drum and the difference between rotational speeds of the second winding flyer and the second drum.

In an advantageous solution, the diameters of both drums are the same, and the same are, in both phases, rotational speeds of both drums and rotational speeds of the first winding and the second unwinding flyers.

An apparatus for stranding elongated elements into a bundle of alternate reverse twists, according to the invention, consists of the winding flyer and the unwinding flyer, rotary arranged along the common axis and situated on both sides of the drum, also rotary arranged. Before the winding flyer a holeplate and a closing die is fixed, and after the unwinding flyer a twist blocking device is situated. A pusher of the bundle can be fixed to the winding flyer.

The pusher is possibly a roll, arranged close to the drum surface on which the bundle is wound, and the axis of roll rotation intersects the axis of drum rotation.

In another embodiment the pusher is a set of rolls arranged close to the drum surface on which the bundle is wound, and situated one after another along line, transverse to the generating line of the drum, the axes of rotation of the rolls intersect in one point on the axis of the drum.

It is advantageous, if the shape of the drum is a truncated cone, whose generating lines in the plane crossing its axis form an angle in the range from 0° to 10°.

It is also advantageous, if the drum is driven by an electric motor, energized from the side of its axle.

In another embodiment according to the invention, an apparatus for stranding elongated elements into a bundle of alternate reverse twists consists of two units situated one after another along the common axis, and each unit consists of the winding flyer and the unwinding flyer, rotary arranged along the common axis and situated on both sides of the drum, also rotary arranged. Before the winding flyer of the first unit the holeplate and closing die is fixed, and after the unwinding flyer of the second unit a twist blocking device is situated.

In the embodiment according to the invention, in which rotating flyers wind twisted bundle on rotating drums and simultaneously, other flyers unwind it from the drums, an alternate reverse stranding can be produced at small changes of rotational speeds. An additional advantage which can be achieved from the embodiment is an essential shortening of length of stranders, due to application of short, drum-type accumulators.

BRIEF DESCRIPTION OF THE DRAWING FIGURES

The subject of the invention will be more precisely explained in the embodiments presented in the figures. FIG. 1 shows schematically a double twist apparatus for the reverse stranding, FIG. 2 shows schematically a quadruple twist apparatus for the reverse stranding, FIG. 3 shows distribution of twists along the stranded bundle in the double twist apparatus, and FIG. 4 shows distribution of twists along the stranded bundle in the quadruple twist apparatus.

DETAILED DESCRIPTION OF THE PREFERRED EMBODIMENTS

Figure 1:
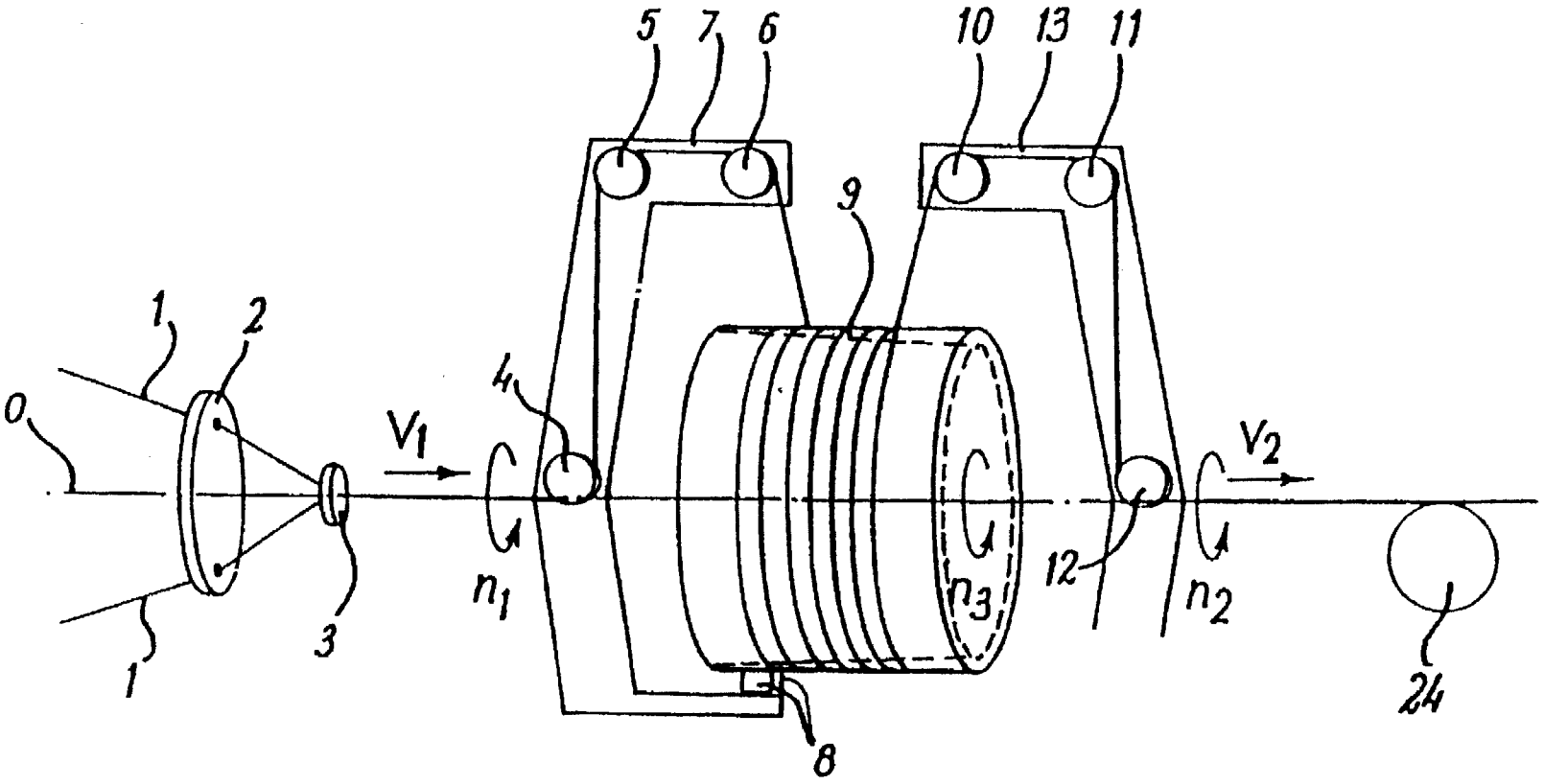
Figure 2:
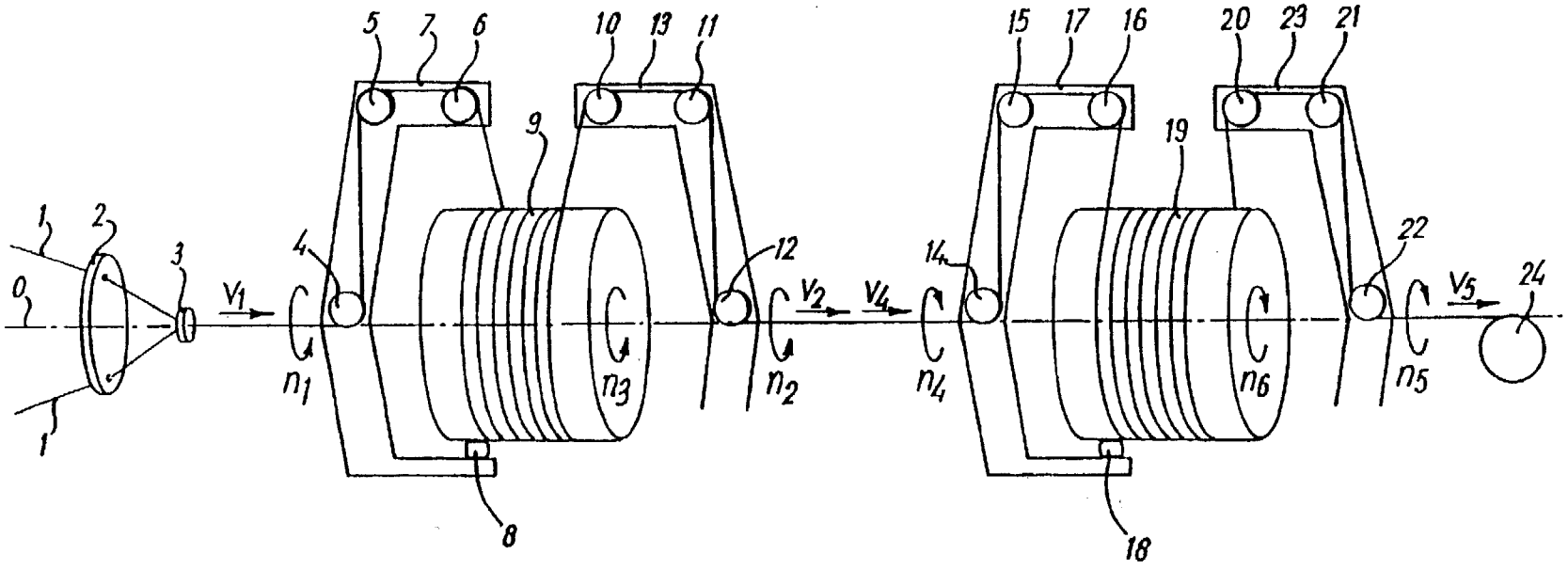
Figure 3:
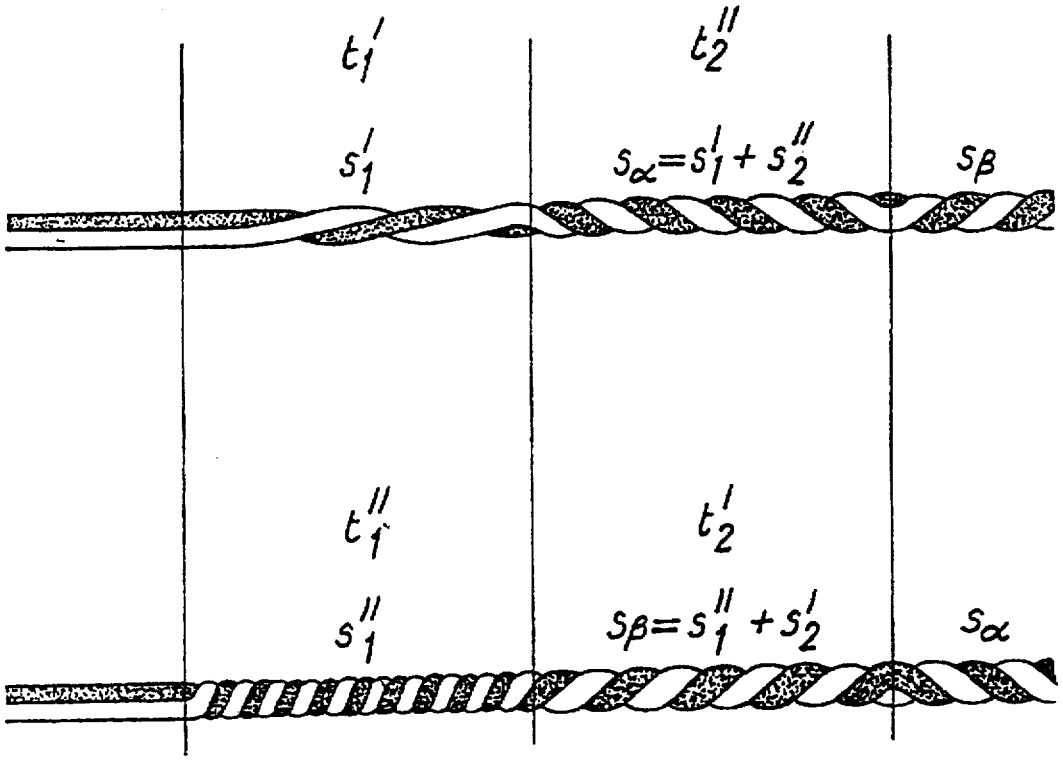
Figure 4:
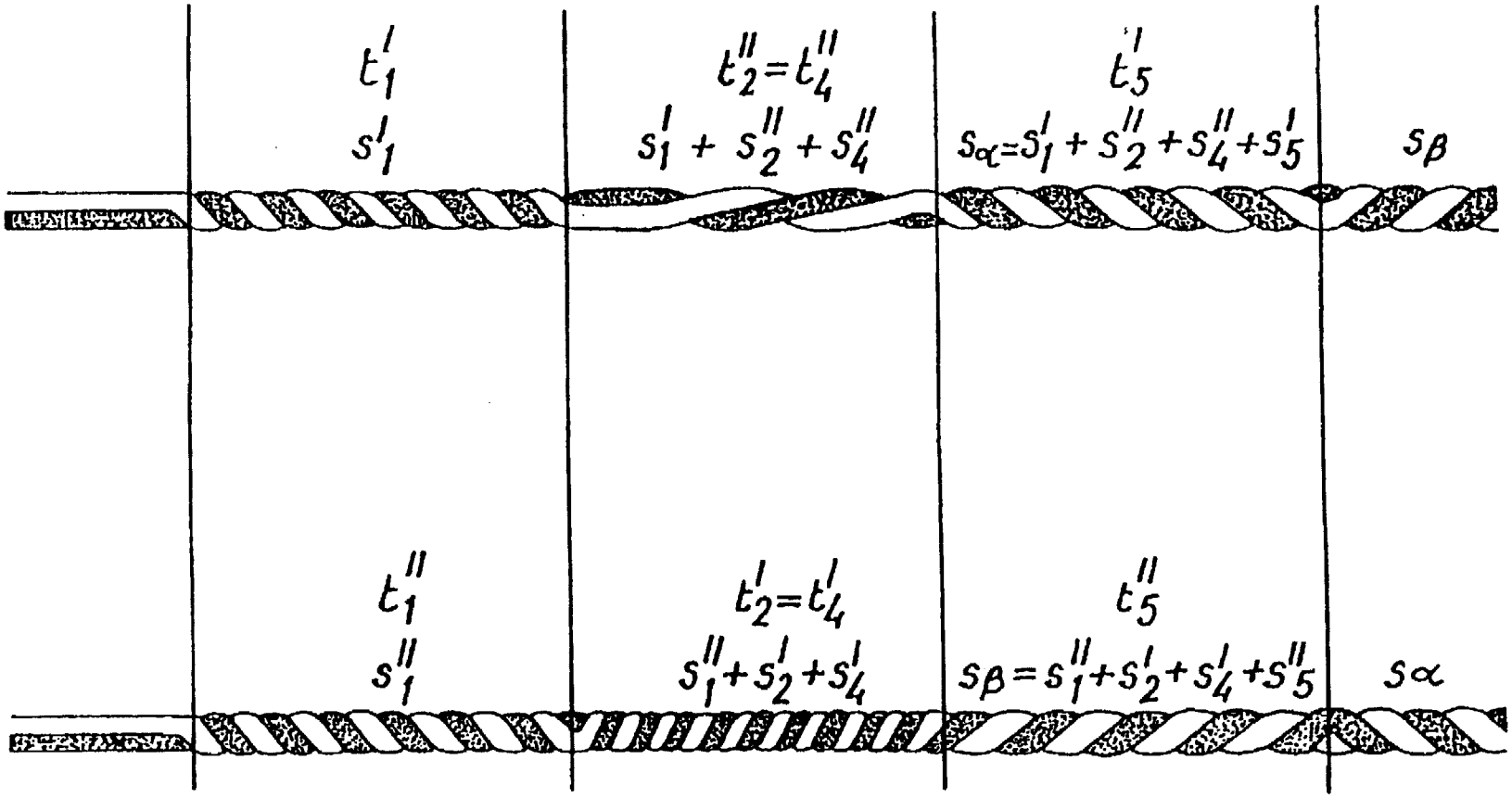

The method according to the invention is based on that, that the bundle of elements enters the winding flyer 7, rotating with periodically changing speed, and producing the first twist $s_1$ in the bundle. Next, after leaving the flyer 7, the bundle is wound by the flyer on the drum 9, which rotates with another speed. Turns of the bundle wound on the drum 9 by the winding flyer 7 are unwound from the drum 9 by the unwinding flyer 13, rotating with periodically changing speed, and producing the second twist $s_2$ in the bundle. Then the bundle is pulled off the flyer 13.

The first twist $s_1$ in the bundle is produced at the entrance to the winding flyer 7 and depends on the difference between rotational speed $n_1$ of the flyer 7 and the rotational speed $n_3$ of the drum 9, and the diameter $d_3$ of the drum. The bundle leaving the unwinding flyer 13 undergoes the second twist $s_2$, and the value of the twist also depends on the difference between rotational speed $n_2$ of the flyer 13 and the rotational speed $n_3$ of the drum 9, and the diameter $d_3$ of the drum. The final strands $s_\alpha$, $s_\beta$ of any point of the bundle is the algebraic sum of both twists $s_1$ and $s_2$.

Repeating period of twisting the bundle of elements consists of two successive phases of twisting. The rotation of the flyers 7 and 13 and the drum 9 are constant during each of the phases and the same length a of the bundle is then twisted. The length of the bundle twisted during the first phase by the winding flyer 7 is then twisted during the second phase by the unwinding flyer 13. The successive length of the bundle twisted in the second phase by the winding flyer 7 is then twisted in the first phase by the unwinding flyer 13.

Assuming that the length of the bundle is not shortened due to twisting and the strand is not lengthened due to elasticity of the bundle elements, the strands of the bundle length, bundle velocities and the durations of flyers rotations in the method according to the invention, are described by the following formulae:

$$s_\alpha = s'_1 + s''_2 = \frac{1}{\pi \cdot d_3} \cdot \left( \frac{n'_1}{n'_1 - n'_3} - \frac{n''_2}{n''_2 - n''_3} \right)$$

$$s_\beta = s''_1 + s'_2 = \frac{1}{\pi \cdot d_3} \cdot \left( \frac{n''_1}{n''_1 - n''_3} - \frac{n'_2}{n'_2 - n'_3} \right)$$

$$v'_1 = \pi \cdot d_3 \cdot (n'_1 - n'_3) \quad v''_1 = \pi \cdot d_3 \cdot (n''_1 - n''_3)$$

$$v'_2 = \pi \cdot d_3 \cdot (n'_2 - n'_3) \quad v''_2 = \pi \cdot d_3 \cdot (n''_2 - n''_3)$$

$$t'_1 = \frac{a}{v'_1} \quad t''_1 = \frac{a}{v''_1} \quad t'_2 = \frac{a}{v'_2} \quad t''_2 = \frac{a}{v''_2}$$

The used symbols denote as follows:

a—length of unidirectional twist, $s_1$ twist produced in the bundle by the unwinding flyer in the first phase, and $s_1$ in the second phase of twisting, $s_2$ twist produced in the bundle by the winding flyer in the first phase, and $s_2$ in the second phase of twisting, $s\alpha$ final, unidirectional strand of the bundle length, $s\beta$ final, unidirectional strand of the bundle length, opposite to $s_\alpha$, $n_1$ rotational speed of the winding flyer in the first phase, and $n_1$ in the second phase of twisting, $n_2$ rotational speed of the unwinding flyer in the first phase, and $n_2$ in the second phase of twisting, $n_3$ rotational speed of the drum in the first phase, and $n_3$ in the second phase of twisting, $d_3$ diameter of the drum, enlarged by the diameter of the bundle $v_1$ velocity of the bundle entering the winding flyer in the first phase, and $v_1$ in the second phase of twisting, $v_2$ velocity of the bundle leaving the unwinding flyer in the first phase, and $v_2$" in the second phase of twisting, $t_1$' duration of rotation of the winding flyer in the first phase, and $t_1$" in the second phase of twisting, $t_2$' duration of rotation of the unwinding flyer in the first phase, and $t_2$" in the second phase of twisting.

It is required that the final strands of opposite directions in the two successive lengths of the bundle are equal, and equal are the sums of the durations of the successive phases in one period of twisting. Thus, the condition of selection of rotational speeds of flyers 7, 13 and the drum 9 to obtain alternately reverse strand, assuming that the length of the bundle is not shortened due to twisting and the strand is not lengthened due to elasticity of the bundle elements, is as follows:

$$\frac{n'_1}{1+\frac{n'_1-n'_3}{n''_1-n''_3}}+\frac{n''_1}{1+\frac{n''_1-n''_3}{n'_1-n'_3}}=\frac{n'_2}{1+\frac{n'_2-n'_3}{n''_2-n''_3}}+\frac{n''_2}{1+\frac{n''_2-n''_3}{n'_2-n'_3}}$$

In the advantageous solution, during the same phase of twisting, the rotational speeds of both flyers 7 and 13 are equal, i.e. $n_1'=n_2'$ i $n_1''=n_2''$, and during both phases equal are the differences between rotational speeds of each flyer 7, 13 and the drum 9 i.e. $n'_1-n'_3=n'_2-n'_3=n_1''-n_3''=n_2''-n_3''$. Then the velocity $v_1$ of the bundle entering the winding flyer and the velocity $v_2$ of the bundle leaving the unwinding flyer are equal and constant during stranding.

It is advantageous, if twisting according to the invention is repeated. Then, the bundle twisted by the first winding flyer 7 and the first unwinding flyer 13 and pulled out of the unwinding flyer 17, enters, situated just after it along the same axis, the second winding flyer, which rotates with changing speed in the opposite direction and produces the third twist $s_4$ in the bundle. After winding the bundle on the second drum 19, which rotates with another speed, and unwinding it by the second unwinding flyer 23, which rotates with changing speed in the same direction as the second unwinding flyer 17 and the drum 19, the fourth twist $s_5$ is produced in the bundle leaving the second unwinding flyer 23. The final strand in any point of the bundle is the algebraic sum of all four twists. A length of the bundle, twisted in the first phase by the first winding flyer 7, is twisted in the second phase by the first unwinding flyer 13 and the second winding flyer 17 and then, again in the first phase, is twisted by the second unwinding flyer 23. Another length of the bundle, twisted in the second phase by the first winding flyer 7, is then twisted in the first phase by the first unwinding flyer 13 and the second winding flyer 17, and next, again in the first phase, it is twisted by the second unwinding flyer 23. Assuming that the length of the bundle is not shortened due to twisting and the strand is not lengthened due to elasticity of the bundle elements, this method of stranding is described by the given below formulae:

$$s_\alpha = s'_1+s''_2+s''_4+s'_5 = \frac{1}{\pi\cdot d_3}\cdot\left(\frac{n'_1}{n'_1-n'_3}-\frac{n''_2}{n''_2-n''_3}\right)-\frac{1}{\pi\cdot d_6}\cdot\left(\frac{n''_4}{n''_4-n''_6}-\frac{n'_5}{n'_5-n'_6}\right)$$

$$s_\beta = s''_1+s'_2+s'_4+s''_5 = \frac{1}{\pi\cdot d_3}\cdot\left(\frac{n''_1}{n''_1-n''_3}-\frac{n'_2}{n'_2-n'_3}\right)-\frac{1}{\pi\cdot d_6}\cdot\left(\frac{n'_4}{n'_4-n'_6}-\frac{n''_5}{n''_5-n''_6}\right)$$

$$v'_1=\pi\cdot d_3\cdot(n'_1-n'_3)v''_1=\pi\cdot d_3\cdot(n''_1-n''_3)$$

$$v'_2=\pi\cdot d_3\cdot(n'_2-n'_3)v''_2=\pi\cdot d_3\cdot(n''_2-n''_3)$$

$$v'_4=\pi\cdot d_6\cdot(n'_4-n'_6)v''_4=\pi\cdot d_6\cdot(n''_4-n''_6)$$

$$v'_5=\pi\cdot d_6\cdot(n'_5-n'_6)v''_5=\pi\cdot d_6\cdot(n''_5-n''_6)$$

-continued $$t'_1=\frac{a}{v'_1}\quad t''_1=\frac{a}{v''_1}\quad t'_2=\frac{a}{v'_2}\quad t''_2=\frac{a}{v''_2}$$

$$t'_4=\frac{a}{v'_4}\quad t''_4=\frac{a}{v''_4}\quad t'_5=\frac{a}{v'_5}\quad t''_5=\frac{a}{v''_5}$$

The additional symbols used in the formulae denote as follows:

- $s_4$—twist produced in the bundle by the second winding flyer,
- $s_5$—twist produced in the bundle by the second unwinding flyer,
- $n_4$—rotational speed of the second winding flyer,
- $n_5$—rotational speed of the second unwinding flyer,
- $n_6$—rotational speed of the second drum,
- $d_6$—diameter of the second drum, enlarged by the diameter of the bundle,
- $v_4$—velocity of the bundle entering the second winding flyer,
- $V_5$—velocity of the bundle entering the second unwinding flyer,
- $t_4$—duration of rotation of the second winding flyer,
- $t_5$—duration of rotation of the second unwinding flyer,
- '—mark of the symbols concerning the first phase of twisting,
- "—mark of the symbols concerning the second phase of twisting.

It is required that the final strands of opposite directions in the two successive lengths of the bundle are equal, and equal are sum of the durations of the successive phases in one period of twisting. Thus, the condition of selection of the rotational speeds of flyers 7, 13, 17, 23 and the drums 9, 19 to obtain alternately reverse strand, assuming that the length of the bundle is not shortened due to twisting and the strand is not lengthened due, to elasticity of the bundle elements, is as follows:

$$\frac{n'_1}{1+\frac{n'_1-n'_3}{n''_1-n''_3}}+\frac{n''_1}{1+\frac{n''_1-n''_3}{n'_1-n'_3}}+\frac{n'_5}{1+\frac{n'_5-n'_6}{n''_5-n''_6}}+\frac{n''_5}{1+\frac{n''_5-n''_6}{n'_5-n'_6}}=\frac{n'_2}{1+\frac{n'_2-n'_3}{n''_2-n''_3}}+\frac{n''_2}{1+\frac{n''_2-n''_3}{n'_2-n'_3}}+\frac{n'_4}{1+\frac{n'_4-n'_6}{n''_4-n''_6}}+\frac{n''_4}{1+\frac{n''_4-n''_6}{n'_4-n'_6}}$$

In the advantageous solution, the product of rotational speed $n_1$ of the first winding flyer 7 and the diameter $d_3$ of the first drum 9 is equal to the product of rotational speed $n_5$ of the second unwinding flyer 23 and the diameter $d_6$ of the second drum, and both product are of the same value for both phases of twisting, i.e. $n_1\cdot d_3=n_5\cdot d_6=n_1\cdot d_3=n_5\cdot d_6$, as well as the product of rotational speed $n_3$ of the first drum 9 end its diameter $d_3$ is equal to the product of rotational speed $n_6$ of the second drum 19 and its diameter $d_6$, and both products are of the same value during both phases of twisting, i.e. $n_3\cdot d_3=n_6\cdot d_6=n_3\cdot d_3=n_6\cdot d_6$, and also, In each phase, the product of the diameter $d_3$ of the first drum 9 and the difference between rotational speeds of the first unwinding flyer 13 and the first drum 9 is equal to the product of the diameter $d_6$ of the second drum 19 end the difference of rotational speeds of the second winding flyer 17 and the second drum 19, i.e. $(n_2-n_3)\cdot d_3=(n_4-n_6)\cdot d_6$ and $(n_2-n_3)\cdot d_3=(n_4-n_6)\cdot d_6$. Then the velocity $v_1$ the bundle entering the first winding flyer 7 and the velocity $v_5$ of the bundle leaving the second unwinding flyer 23 are equal and constant during stranding.

The apparatus for stranding elongated elements into the bundle of alternate reverse twists according to the invention, consists of two flyers 7, 13, or also 17, 23, situated on both sides of the drum 9, or also 19. Each flyer has a shape of the letter L and its axis of rotation goes close to the end of its one segment and is parallel to another segment. The flyers and the drum have the common axis O of rotation. In turning points of the bundle route along the flyers there are guiding pulleys 4, 5, 6 and 10, 11, 12 or also 14, 15, 16 and 20, 21, 22 fixed to the flyers 7 and 13, or also 17 and 23.

The pushers 8, 18 of the bundle turns, wound on the drums 9, 19 are fastened to the winding arms 7, 17 and rotate with them. The task of the pushers is to transfer the turns along the axis of the drum in the direction of stranding. The transfer of turns enable proper winding of the successive turns on the drum by the winding flyer and easy unwinding the turns by the unwinding flyer. The pushers transfer the last wound turn and transfer with it the previously wound turns.

In the exemplary embodiment, the pusher 8, 18 is a rub fixed to the winding flyer 7, 17 in such a way that its axis of rotation intersects the axis O of the drum 9, 19. The roll rotates around the drum 9, 19, close to its surface.

In another embodiment, the pusher 8, 18 is a set of rolls arranged one after another along a line, transverse to the generating line of the drum 9, 19, the axes of rotation of the rolls intersect in one point on the axis of the drum 9, 19, and the set of rolls rotates around the drum 9, 19, close to its surface.

It is advantageous to facilitate transfer of the turns, if the shape of the drum 9, 19 is a truncated cone, which generating lines in the plane crossing its axis form an angle of a few degrees.

The drum 9, 19 is driven by a transmission gear.

In another embodiment, the drum 9, 19 is driven by an electric motor, energized from the side of its axle.

In the double twist apparatus, the elongated elements 1 are threaded through holes of the fixed distributing plate 2 and are collected in the closing die 3, where they are formed into the bundle. Then the bundle is guided along the set of pulleys 4, 5 and 6, fixed to the winding flyer 7, and is wound on the drum 9. The pusher 8 transfers the wound turns along the axis of drum, in the direction of stranding. Simultaneously, the bundle of elements is unwound from the drum 9 by the unwinding flyer 13 and guided along the pulleys 10, 11, and 12, fixed to it, and next the bundle goes through the twist blocking device 24, being a pulley or caterpillar, leaves the apparatus and can be wound on a take-up spool or fed to another work phase. The first twist $s_1$ of the bundle is produced by the winding flyer 7 in the zone between the die 3 and the pulley 4, which rotates together with the winding arm 7. The second twist $s_2$ of the bundle is produced by the unwinding flyer 13, in the zone between the pulley 12, which rotates together with the unwinding flyer 9, and the twist blocking device 24. The winding flyer, the drum and the unwinding flyer rotate around the common axis in the same direction, but with various speeds, which change periodically. Durations of the periodically changing speeds are selected in such a way that the length of the bundle stranded in one direction is equal to the length stranded in opposite direction, and the change of the speed always occurs in the reverse points of the direction of stranding, i.e. between these lengths.

The quadruple twist apparatus consists of two units, i.e. of two described above double twist apparatus, situated one after another, along the same axis O. The bundle stranded in the first unit is guided, omitting the twist blocking device 24, to the second unit, where guidance of the bundle is the same as in the first unit. The third twist $S_4$ is produced in the zone between the pulley 12, rotating together with the first unwinding flyer 13, and the pulley 14, rotating together with the second winding flyer 17. The fourth twist $s_6$ of the bundle is produced in the zone between the pulley 22, rotating together with the second unwinding flyer 23, end the twist blocking device 24. The direction of rotation of the flyers and the drum of the second unit is opposite to the direction of rotation in the first unit. The bundle leaves the second unwinding flyer, goes through the twist blocking device 24, leaves the apparatus and can be wound on a take-up spool or fed to another work phase.

The final strand of the bundle is the algebraic sum of the particular twists produced by the flyers of the apparatus. Two cases have been taken under consideration: the first one, when the bundle is stranded by the double twist apparatus, and the second one, when the bundle is stranded by the quadruple twist apparatus.

I claim:

1. A method of stranding elongated elements into a strand of reverse twists comprising the steps of:

providing a stranding apparatus comprising a first winding flyer, a first drum, and a first unwinding flyer, said first winding flyer, said first drum and said first unwinding flyer having a common axis of rotation;

feeding a bundle of elongated elements through said apparatus, such that the elongated elements pass through said first winding flyer, around the first drum, and through the first unwinding flyer;

rotating the first winding flyer, the first drum and the first unwinding flyer simultaneously in the same direction in at least two alternating twisting phases wherein the rotational speeds of the first winding flyer and the first unwinding flyer in one phase are different from their respective rotational speeds in another phase, whereby the first winding flyer produces a first twist in the bundle while winding the bundle onto the first drum, and the first unwinding flyer produces a second twist in the bundle while unwinding the bundle from the first drum, the relationship between the rotational speeds of the first winding flyer, the first drum, and first unwinding flyer being such that reverse twisting is achieved in operation; and pulling the reversely twisted bundle off the first unwinding flyer.

2. The method of claim 1 wherein there are two twisting phases, and the respective rotational speeds of the first winding flyer, the first drum and the first unwinding flyer are each constant within a respective phase.

3. The method of claim 2 wherein during each respective phase, the rotational speeds of the first winding flyer and the first unwinding flyer are equal, and in each respective phase the difference between the rotational speeds of the flyers and the drum is maintained constant.

4. The method of claim 1 further comprising the steps of:

providing second stranding apparatus comprising a second winding flyer, a second drum, and a second unwinding flyer, said second winding flyer, said second drum and said second unwinding flyer having a common axis of rotation, but rotating in an opposite direction than the flyers and drum of said first stranding apparatus;

feeding the reversely twisted bundle of elongated elements as pulled from the first unwinding flyer through said second stranding apparatus, such that the bundle passes through said second winding flyer, around the second drum, and through the second unwinding flyer;

rotating the second winding flyer, the second drum and the second unwinding flyer simultaneously in the same direction in at least two alternating twisting phases wherein the rotational speeds of the second winding flyer and the second unwinding flyer in one phase are different from their respective rotational speeds in another phase, whereby the second winding flyer produces a third twist in the bundle while winding the bundle onto the second drum, and the second unwinding flyer produces a fourth twist in the bundle while unwinding the bundle from the second drum; and pulling the reversely twisted bundle off the second unwinding flyer.

5. The method of claim 4 wherein there are two twisting phases, and the respective rotational speeds of the winding flyers, the drums and the unwinding flyers are each constant within a respective phase.

6. The method according to claim 5 in which the product of the rotational speed n1 of the first winding flyer and a diameter d3 of the first drum is equal to the product of the rotational speed n5 of the second unwinding flyer and a diameter d6 of the second drum, and both products are of the same value for both phases of twisting, and further in which the product of rotational speed n3 of the first drum and its diameter d3 is equal to the product of rotational speed n6 of the second drum and its diameter d6, and both products are of the same value during both phases of twisting, and further in which, in each phase, the product of the diameter d3 of the first drum and the difference between the rotational speeds n2 of the first unwinding flyer and n3 of the first drum is equal to the product of the diameter d6 of the second drum and the difference of the rotational speeds n4 of the second winding flyer and n6 of the second drum.

7. The method according to claim 6 in which the diameters d3 and d6 of both drums are the same, and the rotational speeds n3 of the first drum and n6 of the second drum are the same in both phases, and the rotational speeds n1 of the first winding flyer and n5 of the second unwinding flyer are the same in both phases.

8. Apparatus for stranding elongated elements into a strand of reverse twists comprising:

a fixed collection die;

a first stranding unit including a first winding flyer, a first drum, and a first unwinding flyer; and a twist blocking device, said first winding flyer, said first drum and said first unwinding flyer being adapted to rotate at different speeds and having a common axis of rotation, said elongated elements passing through said fixed collection die, through said first winding flyer, around said first drum, through said first unwinding flyer and through said twist blocking device, said apparatus further including a pusher fixed on the winding flyer for pushing said twisted strands along an outer surface of the first drum.

9. The apparatus of claim 8 wherein said pusher comprises a roll arranged close to the outer surface of the drum and an axis of roll rotation intersects the axis of rotation of the drum.

10. The apparatus of claim 8 wherein said pusher comprises a set of rolls arranged close to the outer surface of the drum, said rolls being situated one after the other along a line which is transverse to a generating line of the drum and the axes of rotation of the rolls intersects one point on the axis of rotation of the drum.

11. The apparatus of claim 8 in which the drum has the shape of a truncated cone and the generating line has an angle of inclination in the range between 0 and 10 degrees.

12. The apparatus of claim 8 wherein the drum is driven by an electric motor.

13. The apparatus of claim 8 further comprising a second stranding unit comprising a second stranding unit including a second winding flyer, a second drum and a second unwinding flyer having a common axis of rotation which is also common with the axis of rotation of the first winding flyer, first drum and first unwinding flyer of the first stranding unit, said apparatus being arranged such that the twisted strands being pulled off of the first unwinding flyer are inserted into the second winding flyer and the twist blocking unit is arranged after the second unwinding flyer.

* * * * *